US008278621B2

(12) United States Patent
Ahn

(10) Patent No.: US 8,278,621 B2
(45) Date of Patent: Oct. 2, 2012

(54) PORTABLE QUADRUPOLE ION TRAP MASS SPECTROMETER

(75) Inventor: Ho-young Ahn, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1 day.

(21) Appl. No.: 13/073,470

(22) Filed: Mar. 28, 2011

(65) Prior Publication Data

US 2012/0056087 A1 Mar. 8, 2012

(30) Foreign Application Priority Data

Sep. 3, 2010 (KR) ..... 10-2010-0086588

(51) Int. Cl.
*H01J 49/26* (2006.01)

(52) U.S. Cl. ..... 250/290; 250/423 R; 250/424

(58) Field of Classification Search ..... 250/281–283, 250/285, 290–292, 397, 399, 423 R, 424
See application file for complete search history.

(56) References Cited

U.S. PATENT DOCUMENTS

| | | | | |
|---|---|---|---|---|
| 5,032,724 | A * | 7/1991 | Gerlach et al. | 250/305 |
| 5,509,958 | A * | 4/1996 | Van de Leest | 106/287.26 |
| 6,596,990 | B2 | 7/2003 | Kasten et al. | |
| 6,608,303 | B2 | 8/2003 | Amy et al. | |
| 7,002,443 | B2 * | 2/2006 | Ness et al. | 336/57 |
| 8,110,801 | B2 * | 2/2012 | Indermuehle et al. | 250/311 |
| 2002/0185596 | A1 * | 12/2002 | Amy et al. | 250/292 |
| 2009/0166533 | A1 | 7/2009 | Choi et al. | |
| 2011/0024616 | A1 * | 2/2011 | Pringle | 250/282 |

FOREIGN PATENT DOCUMENTS

| | | | |
|---|---|---|---|
| JP | 63-313460 | A | 12/1988 |
| JP | 06-076790 | A | 3/1994 |
| JP | 11-003679 | A | 1/1999 |
| JP | 2009-009863 | A | 1/2009 |
| KR | 10-0933726 | B1 | 12/2009 |

* cited by examiner

*Primary Examiner* — Bernard E Souw
(74) *Attorney, Agent, or Firm* — Sughrue Mion, PLLC

(57) ABSTRACT

A portable quadrupole ion trap mass spectrometer includes an electron emission source, an ion trap including a ring electrode and first and second end cap electrodes arranged opposite sides of the ring electrode, and an ion detector for detecting an amount of ions discharged from the ion trap. The first end cap electrode includes a first aperture through which the electrons emitted by the electron source enter the ion trap, and the second end cap electrode includes a second aperture through which ions are discharged the ion trap. A first electron multiplier is disposed in the first aperture of the first end cap electrode and multiplies an amount of the electrons and input to the ion trap. An ion detector detects an amount of the ions discharged from the ion trap.

20 Claims, 2 Drawing Sheets

PORTABLE QUADRUPOLE ION TRAP MASS SPECTROMETER

CROSS-REFERENCE TO RELATED APPLICATION

This application claims the benefit of Korean Patent Application No. 10-2010-0086588, filed on Sep. 3, 2010, in the Korean Intellectual Property Office, the disclosure of which is incorporated herein in its entirety by reference.

BACKGROUND

1. Field

The present disclosure relates to a portable quadrupole ion trap mass spectrometer, and more particularly, to a quadrupole ion trap mass spectrometer that is compact in size and uses an electron multiplier to improve sensitivity.

2. Description of the Related Art

A quadrupole ion trap mass spectrometer includes an ion trap including a space for trapping ions by using a high frequency electric field and an ion detector for detecting ions emitted from the ion trap by separating trapped ions according to their mass by sequentially increasing a high frequency voltage of the ion trap.

Related art quadrupole ion trap mass spectrometers generally have a large volume and consume a lot of power.

Recently, as interest in personal health has increased, a demand for diagnosing personal health by analyzing organic matter included in exhalation of a person has increased. Also, environmental monitoring through detection of contaminants, environmental hormones, germs, and viruses is needed. Therefore, a compact, portable quadrupole ion trap mass spectrometer meeting the above demands is needed.

SUMMARY

One or more embodiments provide a portable compact quadrupole ion trap mass spectrometer that operates at a low power.

According to an aspect of an embodiment, there is provided a portable quadrupole ion trap mass spectrometer including an electron emission source which emits electrons, an ion trap which is configured to capture ions generated when gas is ionized by the electrons emitted from the electron emission source, the ion trap including a ring electrode and first and second end cap electrodes which are arranged on opposite sides of the ring electrode, wherein the first end cap electrode includes a first aperture through which the electrons emitted by the electron source enter the ion trap, and the second end cap electrode includes a second aperture through which ions are discharged the ion trap, and a first electron multiplier which is disposed in the first aperture of the first end cap electrode and multiplies an amount of the electrons and input to the ion trap, and an ion detector which detects an amount of the ions discharged from the ion trap The diameter of the first electron multiplier may be approximately 100-2000 μm.

A plurality of holes may be formed in the first electron multiplier and each of the holes may have a diameter of approximately 10-500 nm.

The first electron multiplier may have a thickness of approximately 10-100 μm.

The first electron multiplier may be an alumina thin film in which the plurality of holes are formed and the holes are coated with a secondary electron generating material.

The secondary electron generating material may be magnesium oxide (MgO) or zinc oxide (ZnO).

A conductive film may be formed on each of upper and lower surfaces of the first electron multiplier.

The ion detector may include a second electron multiplier for neutralizing ions discharged from the ion trap, generating second electrons, and multiplying an amount of the second electrons passing through the second electron multiplier, and an current detector for measuring an amount of the second electrons colliding against the current detector.

The second electron multiplier for multiplying an amount of the electrons may be arranged in the second aperture.

The electron emission source may be a filament or a cold cathode emission source.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
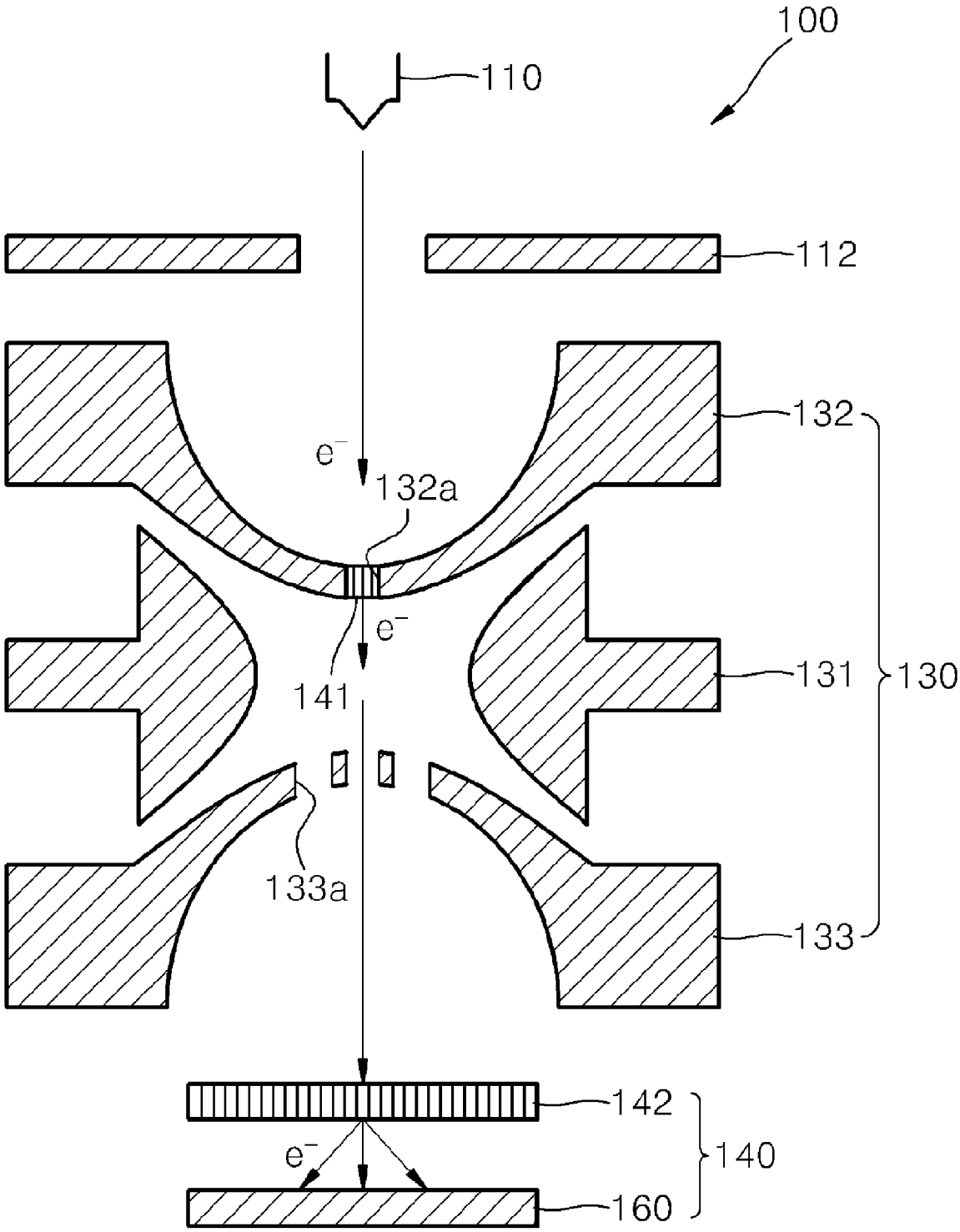
FIG. 1 is a cross-sectional view of a portable quadrupole ion trap mass spectrometer according to an embodiment.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description.

FIG. 1 is a cross-sectional view of a portable quadrupole ion trap mass spectrometer 100 according to an embodiment. Referring to FIG. 1, the quadrupole ion trap mass spectrometer 100 includes a hot filament 110 that is an electron emission source, an ion trap 130, and an ion detector 140.

The hot filament 110 is heated by applying current supplied by a battery or other power source (not shown) to emit hot electrons. The emitted hot electrons pass through a cover (gate) 112 arranged between the ion trap 130 and the hot filament 110 and enters the ion trap 130.

The ion trap 130 includes a ring electrode 131 having opposite sides that are open, and a pair of first and second end cap electrodes 132 and 133 arranged to face each other with respect to both open sides of the ring electrode 131. Opposing surfaces of the ring electrode 131 and the first and second end cap electrodes 132 and 133 are convex with respect to each other. A first aperture **132*a* is formed at a center of the first end cap electrode 132. The first aperture 132*a* is an entry through which hot electrons emitted from the hot filament 110 enter the ion trap 130. The first aperture 132*a* has a diameter of approximately 100-2000 μm. A first electron multiplier 141 is provided in the first aperture 132*a*. The diameter of the first electron multiplier 141 is substantially the same as that of the first aperture 132*a***.

Although the hot filament 110 is provided as the electron emission source in FIG. 1, embodiments are not limited thereto. For example, a cold cathode may be used as an electron emission source. In this case, a predetermined voltage is applied between a gate and a cathode to emit electrons. Since the hot filament 110 requires preheating, a voltage is continuously applied so that power consumption may be large. In contrast, since a voltage is applied to a cold cathode only when electrons are emitted, the power consumption of a cold cathode may be reduced.

Figure 2:
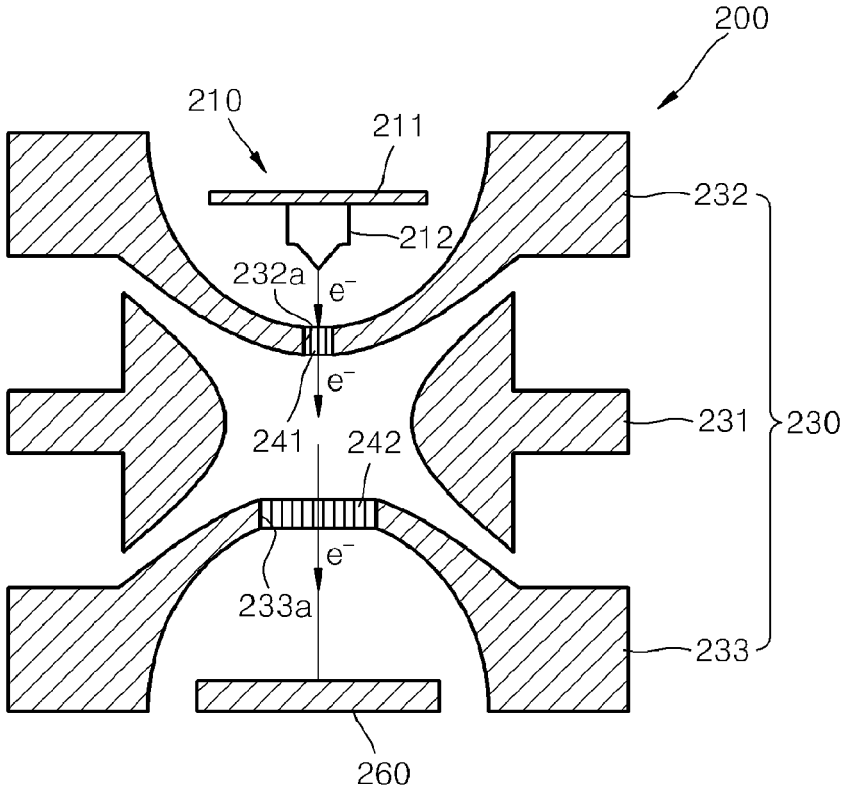
FIG. 2 is a cross-sectional view of an electron multiplier according to an embodiment.

FIG. 2 is a cross-sectional view of a first electron multiplier 141 according to an embodiment. Referring to FIG. 2, the first electron multiplier 141 increases the number of electrons emitted by an electron emission source used for a compact mass spectrometer such as the portable quadrupole ion trap mass spectrometer 100 so as to improve ion detection sensitivity.

In FIG. 2, a plurality of holes 151 are formed in the first electron multiplier 141. The first electron multiplier 141 includes an alumina thin film 150 in which the holes 151 are formed, for example, an anodic aluminium oxide thin film. Each of the holes 151 is coated with a secondary electron generating material 152. The secondary electron generating material 152 may be magnesium oxide (MgO) or zinc oxide (ZnO). A conductive material 153, for example, aluminium, is deposited on upper and lower surfaces of the alumina thin film 150. When a predetermined voltage is applied to both surfaces of the alumina thin film 150, the electrons passing through each of the holes 151 are multiplied by several to hundreds of times.

Each of the holes 151 formed in the alumina thin film 150 has a diameter of approximately 10-500 nm. When the diameter of each of the holes 151 is not greater than 10 nm, it is difficult to coat the inside of each of the holes 151 with the secondary electron generating material 152. When the diameter of each of the holes 151 is not less than 500 nm, the number of holes is limited.

The thickness of the first electron multiplier 141 is approximately 10-100 μm. When the thickness of the first electron multiplier 141 increases, the manufacturing cost of the first electron multiplier 141 may increase.

A second aperture 133*a* is formed in the second end cap electrode 133. The second aperture 133*a* is an exit for the ions emitted from the ion trap 130. The second aperture 133*a* includes a plurality of holes so that distortion of electric field distribution due to an applied voltage may be minimized. The second aperture 133*a* may have, for example, a mesh shape.

A second electron multiplier 142 is disposed at a given distance from the second aperture 133*a*. The structure of the second electron multiplier 142 is substantially the same as that of the first electron multiplier 141 of FIG. 2, such that like reference numerals refer to the like elements and a detailed description thereof will be omitted. The ions output from the second aperture 133*a* are neutralized whiling colliding against the second electron multiplier 142. Electrons generated in the above process are multiplied by passing through the holes 151 of the second electron multiplier 142. The second electron multiplier 142 increases the number of electrons included in ions measured by the portable quadrupole ion trap mass spectrometer 100 so as to improve ion detection sensitivity.

The electrons multiplied by passing through the second electron multiplier 142 collide against a current detector 160. The current detector 160 measures the amount of electrons, that is, the amount of ions, by measuring current. The second electron multiplier 142 improves the ion detection sensitivity by increasing the number of electrons included in the ions measured by the portable quadrupole ion trap mass spectrometer 100. The second electron multiplier 142 and the current detector 160 may constitute the ion detector 140.

In the operation of the portable quadrupole ion trap mass spectrometer 100 according to the present embodiment, current is applied to the hot filament 110 to heat the hot filament 110. The hot filament 110 emits hot electrons which pass through the cover 112. The hot electrons then pass through the holes 151 of the first electron multiplier 141 so as to be multiplied by several to hundreds of times. The multiplied electrons enter the ion trap 130 through the first aperture 132*a* and ionize gas in a space of the ion trap 130 by impact ionization. Ions are sequentially discharged out of the ion trap 130 through the second aperture 133*a* in order of weight from lightest to heaviest by increasing a radio frequency (RF) voltage applied to the ring electrode 131. The ions discharged through the second aperture 133*a* generate electrons in the second electron multiplier 142. The electrons are multiplied by passing through the holes 151 in the second electron multiplier 142. As the multiplied electrons arrive at the current detector 160, the amount of ions is measured according to a current value measured by the current detector 160.

According to the present embodiment, since the first electron multiplier 141 in the ion trap 130 multiplies the electrons input to the ion trap 130, the number of collisions between the electrons and the gas increases by the increased number of the electrons. As a result, the number of ions increases so that measurement sensitivity may be improved. Also, the number of electrons generated by an electron emission source may be reduced by using the first electron multiplier 141. Also, the current used by the electron emission source may be reduced. In addition, since a cold cathode electron emission source can be used, the current used by the electron multiplier can be reduced. Thus, the portable quadrupole ion trap mass spectrometer 100 may be operated using a small battery so that a compact, portable quadrupole ion trap mass spectrometer may be manufactured.

Figure 3:
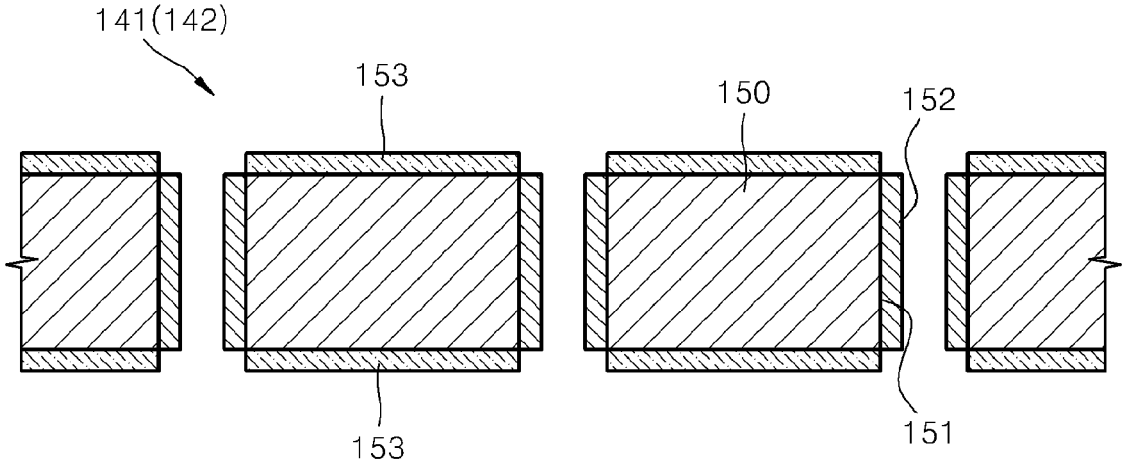
FIG. 3 is a cross-sectional view of a portable quadrupole ion trap mass spectrometer according to another embodiment.

FIG. 3 is a cross-sectional view of a portable quadrupole ion trap mass spectrometer 200 according to another embodiment.

Referring to FIG. 3, the portable quadrupole ion trap mass spectrometer 200 includes a cold cathode 210 that is an electron emission source, an ion trap 230, and an ion detector.

The cold cathode 210 includes a tip 212 and a cathode 211. When a predetermined negative voltage is applied to the cathode 211, the cathode 211 emits electrons.

The ion trap 230 includes a ring electrode 231 having both sides that are open, and a pair of first and second end cap electrodes 232 and 233 arranged to face each other with respect to both open sides of the ring electrode 231. The ring electrode 231 and the first and second end cap electrodes 232 and 233 are formed to be convex with respect to the opposite surfaces facing each other. A first aperture 232*a* is formed at the center of the first end cap electrode 232. The first aperture 232*a* is an entry through which the electrons emitted from the cold cathode 210 enter the ion trap 230. A ground voltage may be applied to the first end cap electrode 232 to draw the electrons emitted from the tip 212 of the cold cathode 210. The first aperture 232*a* has a diameter of approximately 100-2000 μm. A first electron multiplier 241 is disposed in the first aperture 232*a*.

Since a voltage is applied to the cold cathode 210 only when the cold cathode 210 emits electrons, power consumption is reduced. Also, since a small amount of voltage is applied owing to the operation of the first electron multiplier 241, the tip 212 may be prevented from being damaged by the ion matter.

The structure of the first electron multiplier 241 is the same as that of the first electron multiplier 141 of FIG. 2. The first electron multiplier 241 improves ion detection sensitivity by increasing the number of electrons from the cold cathode 210.

A second aperture 233*a* is formed in the second end cap electrode 233. A second electron multiplier 242 is disposed in the second aperture 233*a*. Since the structure of the second electron multiplier 242 is substantially the same as that the first electron multiplier 141 of FIG. 2, a detailed description thereon will be omitted herein and like reference numerals refer to the like elements. The ions discharged from the ion trap 230 are neutralized by colliding against the second electron multiplier 242 and electrons are generated. The electrons pass through the holes 151 of the second electron multiplier 242 and are thereby multiplied. The second electron multiplier 242 improves ion detection sensitivity by increasing the number of electrons included in the ions measured by the compact portable quadrupole ion trap mass spectrometer 200.

The electrons multiplied by passing through the second electron multiplier 242 collide against a current detector 260. The current detector 260 measures the amount of electrons, that is, the amount of ions, by measuring current. The second electron multiplier 242 improves ion detection sensitivity by increasing the number of electrons included in the ions measured by the compact portable quadrupole ion trap mass spectrometer 200. The second electron multiplier 242 and the current detector 260 may constitute the ion detector.

According to the present embodiment, since the second electron multiplier is arranged in the second aperture and the cold cathode is arranged close to the first aperture, a structure of the ion trap mass spectrometer becomes compacter. Also, since the current used by the electron emission source is reduced due to the use of the first electron multiplier, a compact, portable mass spectrometer may be manufactured using a small battery.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A portable quadrupole ion trap mass spectrometer comprising:

an electron emission source which emits electrons;

an ion trap which is configured to capture ions generated when gas is ionized by the electrons emitted from the electron emission source, the ion trap comprising:

a ring electrode;

first and second end cap electrodes which are arranged on opposite sides of the ring electrode, wherein the first end cap electrode includes a first aperture through which the electrons emitted by the electron source enter the ion trap, and the second end cap electrode includes a second aperture through which ions are discharged from the ion trap; and a first electron multiplier which is disposed in the first aperture of the first end cap electrode and multiplies an amount of the electrons and input to the ion trap; and an ion detector which detects an amount of the ions discharged from the ion trap.

2. The portable quadrupole ion trap mass spectrometer of claim 1, wherein the diameter of the first electron multiplier is approximately 100 μm to 2000 μm.

3. The portable quadrupole ion trap mass spectrometer of claim 1, wherein a plurality of holes are formed in the first electron multiplier and each of the plurality of holes has a diameter of approximately 10 nm to 500 nm.

4. The portable quadrupole ion trap mass spectrometer of claim 3, wherein the first electron multiplier has a thickness of approximately 10 μm to 100 μm.

5. The portable quadrupole ion trap mass spectrometer of claim 1, wherein the first electron multiplier comprises an alumina thin film in which the plurality of holes are formed, and a secondary electron generating material coating an interior surface of each of the plurality of holes.

6. The portable quadrupole ion trap mass spectrometer of claim 5, wherein the secondary electron generating material is magnesium oxide or zinc oxide.

7. The portable quadrupole ion trap mass spectrometer of claim 5, wherein the first electron multiplier further comprises a conductive film formed on each of upper and lower surfaces of the alumina thin film.

8. The portable quadrupole ion trap mass spectrometer of claim 1, wherein the ion detector comprises:

a second electron multiplier which neutralizes the ions discharged from the ion trap, generates second electrons, and multiplies an amount of the second electrons passing through the second electron multiplier; and an current detector which measures an amount of the second electrons colliding against the current detector.

9. The portable quadrupole ion trap mass spectrometer of claim 8, wherein the second electron multiplier is disposed in the second aperture of the second end cap electrode.

10. The portable quadrupole ion trap mass spectrometer of claim 9, wherein the diameter of the second electron multiplier is approximately 100 μm to 2000 μm.

11. The portable quadrupole ion trap mass spectrometer of claim 9, wherein a plurality of holes are formed in the second electron multiplier and each of the plurality of holes has a diameter of approximately 10 nm to 500 nm.

12. The portable quadrupole ion trap mass spectrometer of claim 9, wherein the second electron multiplier has a thickness of approximately 10 μm to 100 μm.

13. The portable quadrupole ion trap mass spectrometer of claim 9, wherein the second electron multiplier comprises an alumina thin film in which the plurality of holes are formed, and a secondary electron generating material which coats an interior surface of each of the plurality of holes.

14. The portable quadrupole ion trap mass spectrometer of claim 13, wherein the secondary electron generating material is magnesium oxide or zinc oxide.

15. The portable quadrupole ion trap mass spectrometer of claim 9, wherein the second electron multiplier further comprises a conductive film formed on each of upper and lower surfaces of the alumina thin film.

16. The portable quadrupole ion trap mass spectrometer of claim 1, wherein the electron emission source comprises a filament or a cold cathode emission source.

17. A quadrupole ion trap mass spectrometer comprising:

an electron emission source which emits electrons;

an ion trap comprising:

a first end cap electrode including a first aperture through which the electrons emitted by the electron source enter the ion trap, a second end cap electrode including a second aperture through which ions are discharged the ion trap, and a first electron multiplier which is disposed in the first aperture of the first end cap electrode and multiplies an amount of the electrons input to the ion trap; and an ion detector which detects an amount of the ions discharged from the ion trap.

18. The quadrupole ion trap mass spectrometer of claim 17, wherein the ion trap further comprises a ring electrode which is interposed between the first end cap electrode and the second end cap electrode, and the ion detector comprises a second electron multiplier and a current detector.

19. The quadrupole ion trap mass spectrometer of claim 18, wherein the second electron multiplier disposed in the second aperture of the second end cap electrode.

20. The quadrupole ion trap mass spectrometer of claim 17, wherein the first electron multiplier comprises a thin film in which a plurality of holes are formed, and each of the plurality of holes has a diameter of approximately 10 nm to 500 nm.

* * * * *